US009627122B2

(12) United States Patent
Mahajan et al.

(10) Patent No.: US 9,627,122 B2
(45) Date of Patent: Apr. 18, 2017

(54) HIGH TEMPERATURE SOLENOID ACTUATOR

(71) Applicant: HONEYWELL INTERNATIONAL INC., Morristown, NJ (US)

(72) Inventors: Deepak Pitambar Mahajan, Karnataka (IN); Jimmy Wiggins, Chandler, AZ (US); Siva Bavisetti, Karnataka (IN); Narasimha Reddy Venkatarayappa, Karnataka (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 170 days.

(21) Appl. No.: 14/474,560

(22) Filed: Sep. 2, 2014

(65) Prior Publication Data

US 2016/0064132 A1 Mar. 3, 2016

(51) Int. Cl.

| | |
|---|---|
| ***H01F 5/02*** | (2006.01) |
| ***H01F 7/16*** | (2006.01) |
| ***H01F 7/127*** | (2006.01) |

(52) U.S. Cl.

CPC ..... *H01F 7/1607* (2013.01); *H01F 5/02* (2013.01); *H01F 7/127* (2013.01)

(58) Field of Classification Search

CPC ..... H01F 7/1607; H01F 5/02

See application file for complete search history.

(56) References Cited

U.S. PATENT DOCUMENTS

| | | | | |
|---|---|---|---|---|
| 1,928,846 A * | 10/1933 | Allen | H01H 51/065 335/156 |
| 2,318,672 A * | 5/1943 | Claytor | B60R 16/005 335/261 |
| 5,281,940 A | 1/1994 | Goto | |
| 8,436,704 B1 | 5/2013 | Venkataraghavan et al. | |

OTHER PUBLICATIONS

Archive for the solenoid components category; Profiling solenoids; http://rostratransmission.wordpress.com/category/solenoid-components; May 7, 2010.

* cited by examiner

*Primary Examiner* — Ramon M Barrera
(74) *Attorney, Agent, or Firm* — Lorenz & Kopf, LLP

(57) ABSTRACT

A solenoid actuator includes a housing, a bobbin assembly, a coil, and a washer. The bobbin assembly is disposed at least partially within the housing, and includes a return pole and an armature. The return pole is fixedly coupled to the housing, and the armature is axially movable within the housing. The coil is disposed within the housing and is wound around at least a portion of the bobbin assembly. The washer is disposed between the coil and a portion of the bobbin assembly and surrounds a portion of the return pole. The washer is formed of an electrical insulator material.

18 Claims, 4 Drawing Sheets

HIGH TEMPERATURE SOLENOID ACTUATOR

TECHNICAL FIELD

The present invention generally relates to solenoids, and more particularly relates to a solenoid actuator for high temperature environments.

BACKGROUND

Recently, lower fuel consumption and emission requirements are driving aircraft engine original equipment manufacturers (OEM's) to increase cycle temperature and pressure ratio. As a result, nacelle and bleed air temperatures are increasing. This has led to the development of various components, such as solenoid actuators, that can operate in relatively high temperature (e.g., up to 600° F.) environments.

Presently, the process of winding the coil of a high temperature solenoid actuator begins by crimping the start end of coil, which is formed of magnet wire, to a lead wire very close to one end of the bobbin assembly. One loop of the magnet wire is wound around the bobbin assembly to provide strain relief for the coil start end. To facilitate the crimp and to further improve coil start end strain relief, the end of the bobbin assembly is machined with a groove. Unfortunately, the groove reduces the effective cross sectional area of the bobbin assembly, which reduces the magnetic performance and efficiency of the solenoid actuator, and thus the electromagnetic force generated by the solenoid actuator.

In addition to the above, it is noted that the machined groove has edges, which can damage the magnet wire during the winding and assembly process. It can also be very difficult to insert the magnet wires into the groove. In particular, to protect the coil from short circuiting and to provide good dielectric strength, multiple layers of cement saturated fiber glass tape are inserted between the coil assembly and bobbin assembly. Inserting this tape into the grooves can be a very difficult, tedious, and time-consuming process.

Hence, there is a need for a high temperature solenoid actuator that exhibits improved magnetic performance and efficiency over current solenoid actuators, and that can be simply manufactured without damaging the magnet wire. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a solenoid actuator includes a housing, a bobbin assembly, a coil, and a washer. The bobbin assembly is disposed at least partially within the housing, and includes a return pole and an armature. The return pole is fixedly coupled to the housing, and the armature is axially movable within the housing. The coil is disposed within the housing and is wound around at least a portion of the bobbin assembly. The washer is disposed between the coil and a portion of the bobbin assembly and surrounds a portion of the return pole. The washer is formed of an electrical insulator material.

In another embodiment, a solenoid actuator includes a housing, a bobbin assembly, a coil, and a washer. The bobbin assembly is disposed at least partially within the housing, and includes a return pole and an armature. The return pole is fixedly coupled to the housing, and the armature is axially movable within the housing. The coil is disposed within the housing and is wound around at least a portion of the bobbin assembly. The washer is disposed between the coil and a portion of the bobbin assembly and surrounds a portion of the return pole. The washer is formed of a glass ceramic material and includes a first end surface, a second end surface, an outer circumferential surface between the first and second end surfaces, an inner circumferential surface between the first and second end surfaces, and a circumferential groove formed in the first end surface. The circumferential groove has a portion of the coil disposed therein.

In yet another embodiment, a solenoid actuator a housing, a bobbin assembly, a coil, a dielectric material, and a washer. The bobbin assembly is disposed at least partially within the housing, and includes a return pole and an armature. The return pole is fixedly coupled to the housing, and the armature is axially movable within the housing. The coil is disposed within the housing and is wound around at least a portion of the bobbin assembly. The dielectric material is disposed between the coil and at least a portion of the bobbin assembly. The washer is disposed between the coil and a portion of the bobbin assembly and surrounds a portion of the return pole. The washer is formed of an electrical insulator material and includes a first washer portion surrounding a first portion of the return pole, and a second washer portion surrounding a second portion of the return pole. The second washer portion engages the first washer portion.

Furthermore, other desirable features and characteristics of the solenoid actuator will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
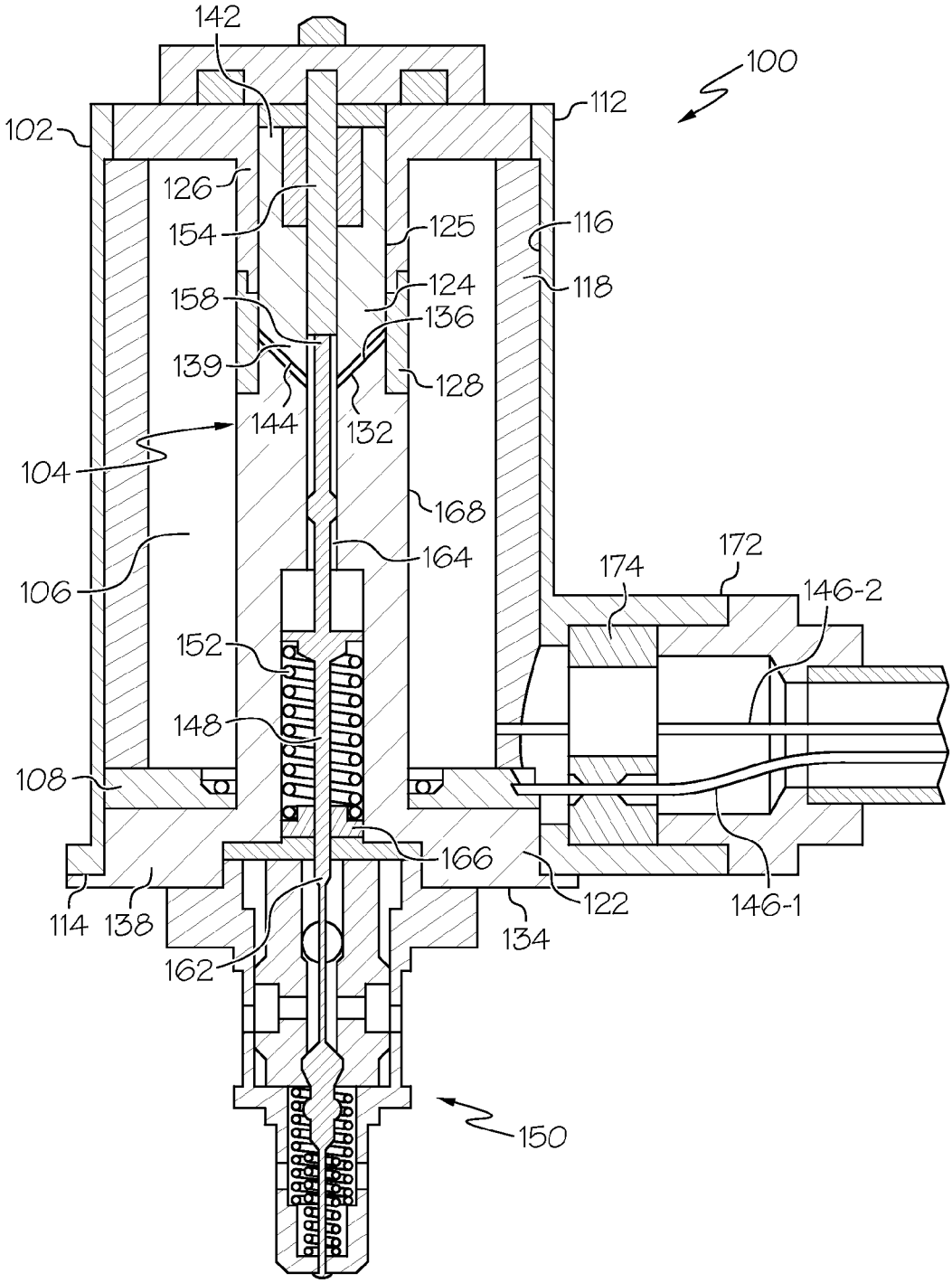
FIG. 1 depicts a cross section view of one exemplary embodiment of a high temperature solenoid actuator.

Referring to FIG. 1, a cross section view of one exemplary embodiment of a high temperature solenoid actuator 100 is depicted. The solenoid actuator 100 includes at least a housing 102, a bobbin assembly 104, a coil 106, and at least one washer 108. The housing 102 is configured to include a first end 112, a second end 114, and an inner surface 116 that defines a housing cavity 118. The housing 102 may comprise any one of numerous materials having a relatively high magnetic permeability such as, for example, magnetic steel. The housing 102, in addition to having a plurality of components disposed therein, provides a flux path, together with the bobbin assembly 104, for magnetic flux that the coil 106 generates when it is electrically energized.

The bobbin assembly 104 includes at least a return pole 122 and an armature 124, but in the depicted embodiment additionally includes a yoke 126 and an interrupter 128. The return pole 122 is fixedly coupled to the housing second end 114 and extends into the housing cavity 118. The return pole 122 preferably comprises a material having a relatively high magnetic permeability. The return pole 122, together with the housing 102, armature 124, and yoke 126 provides a magnetic flux path for the magnetic flux that is generated by the coil 106 when it is energized. The return pole 122 includes a return pole first end 132 and a return pole second end 134. The return pole first end 132 extends into the housing cavity 118. The return pole first end 132 is surrounded by, or at least partially surrounded by, the coil 106, and defines an armature seating surface 136. The return pole second end 134 defines a flange portion 138 that is disposed within the housing cavity 118, and on which the washer 108 is disposed.

The armature 124 is disposed at least partially within the housing 102 and extends at least partially into the housing cavity 118. The armature 124 preferably comprises a material having a relatively high magnetic permeability and, as noted previously, together with the housing 102, return pole 122, and yoke 126 provides a magnetic flux path for the magnetic flux that is generated by the coil 106 when it is energized. The armature 124 is axially movable within the housing 102 between a first position and a second position. Because the armature 124 is movable within the housing 102, the armature 124 may additionally include, at least in some embodiments, a friction-reducing coating 125 on its outer surface. The armature 124 additionally includes an armature first end 139 and an armature second end 142. The armature first end 139 is at least partially surrounded by the coil 106, and defines a return pole engagement surface 144.

The interrupter 128 is coupled to the yoke 126, and is disposed between the return pole 122 and the armature 124. The interrupter 128 diverts the magnetic flux in the working air gap when the coil 106 is energized. The interrupter 128 may be manufactured from various non-magnetic materials, such as brass or non-magnetic steel (e.g. CRES 302).

The coil 106 is disposed within the housing 102 and is adapted to be electrically energized from a non-illustrated electrical power source. As noted above, when it is energized, the coil 106 generates magnetic flux. In the depicted embodiment, the coil 106 is wound around a portion of the bobbin assembly 104, and comprises a relatively fine gauge (e.g., 30-38 AWG) magnet wire, though larger gauge magnet wire could also be used. The magnet wire may be fabricated from any one of numerous conductive materials including, but not limited to, copper, aluminum, nickel, and silver. As FIG. 1, further depicts, and as will be described in more detail further below, the opposing ends of the coil 106 are electrically coupled to a pair of lead wires 146 (146-1, 146-2). In the depicted embodiment, the lead wires 146 are crimped to the opposing ends of the coil 106.

The depicted solenoid actuator 100 additionally includes an actuation rod 148, a spring 152, and a stopper 154. The actuation rod 148 includes a first end 158 and a second end 162. The actuation rod 148 is coupled, via its first end 158, to the armature 124, and extends through a return pole bore 164 that extends between the return pole first end 132 and the return pole second 134. The actuation rod 148 also extends from the housing 102 to its second end 162. The second end 162 is coupled to a component 150, such as, for example, a valve, that is to be actuated by the solenoid actuator 100. It will be appreciated that the actuation rod 148 may be coupled to the armature 124 using any one of numerous techniques. In the depicted embodiment, however, the actuation rod 148 is coupled to the armature 124 via clearance fit.

The spring 152 is disposed within the housing 102 and is configured to supply a bias force to the armature 124 that urges the armature 124 toward the first position. The spring 152 may be variously disposed to implement this functionality. In the depicted embodiments, the spring 152 is disposed within the return pole bore 164 and engages the return pole 122 and lands 166 that are formed on or coupled to the actuation rod 148. Thus, the spring 152 supplies the bias force to the armature 124 via the actuation rod 148. In other embodiments, the spring 152 may be variously disposed within the housing 102 to supply the bias force to the armature 124.

The stopper 154 is disposed within the housing cavity 118 between the housing first end 112 and the armature second end 142. The stopper 154 restricts movement of the armature 124 once the bias force is applied by the spring 152. The stopper 154 also defines the stroke or mechanical displacement of the armature 124. The stopper 154 may be manufactured from various non-magnetic materials, such as brass or non-magnetic steel (e.g. CRESS 302).

The washer 108 is disposed within the housing cavity 118 between the coil 106 and a portion of the bobbin assembly 104. More specifically, and as was noted above, the washer 108 is disposed on the flange portion 138 of the return pole 122. The washer 108, which is preferably formed of an electrical insulator material, additionally surrounds a portion of the return pole 122. The particular electrical insulator material that the washer 108 is formed of may vary, but in one particular embodiment the washer 108 comprises a glass ceramic material. Some preferable characteristics of this particular material include its relatively low thermal conductivity, its continuous use temperature of 800° C., and its peak temperature of 1000° C.

Before proceeding further, it is noted that although the depicted solenoid actuator 100 includes only one washer 108, the solenoid actuator 100 could include one or more additional washers 108. For example, a second washer 108 could be disposed between the coil 106 and the yoke 126, if needed or desired.

Figure 2:
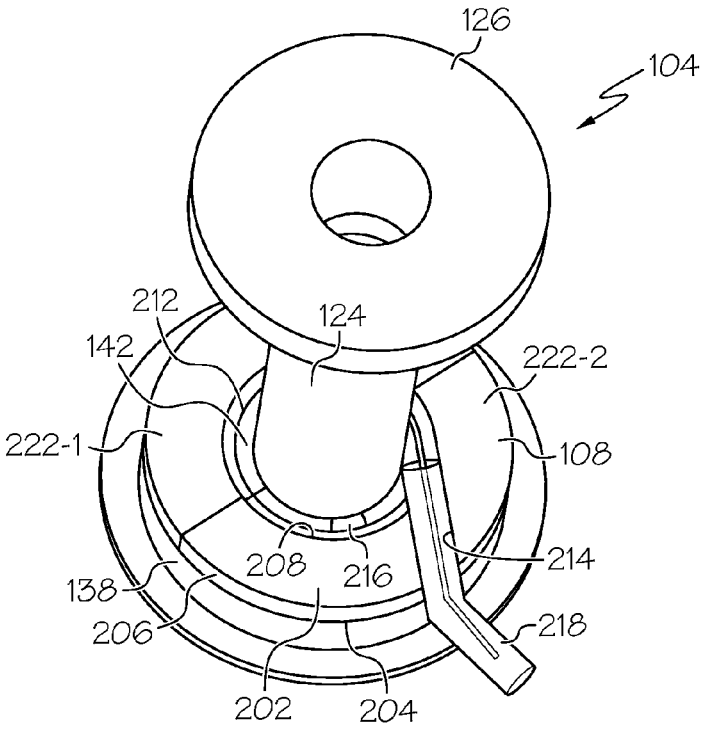
FIG. 2 depicts one embodiment of a bobbin assembly and washer that may be used to implement the actuator of FIG. 1.

Turning now to FIG. 2, it is seen that the washer 108 is generally ring-shaped, and includes a first end surface 202, a second end surface 204, an outer circumferential surface 206, and an inner circumferential surface 208. Moreover, the first end surface 202 has two strain relief grooves formed therein—a circumferential groove 212 and an exit groove 214. The circumferential groove 212 is disposed adjacent the inner circumferential surface 208, and the exit groove 214 extends between the circumferential groove 212 and the outer circumferential surface 206. The circumferential groove 212 is dimensioned so that a portion of the coil 106 (not illustrated in FIG. 2), a portion of one of the lead wires 142, and the crimp joint 216 that joins the start end of the coil 106 and the lead wire 142 may all be disposed in the circumferential groove 212. The exit groove 214 is dimensioned so that a portion of the lead wire 142 that is connected to the coil start end may be disposed therein. As FIG. 2 further depicts, the exit groove 214 may be dimensioned to accommodate a fiber glass sleeve 218 that the lead wire 142 may extend through.

The washer 108 may be variously configured and implemented. For example, it may be formed as a single, unitary portion or it may be formed of multiple portions. In one particular embodiment, the washer 108 is formed of two portions 222—a first washer portion 222-1 and a second washer portion 222-2. The first and second washer portions 222 engage each other, and each surrounds a portion of the return pole 122.

Figure 3:
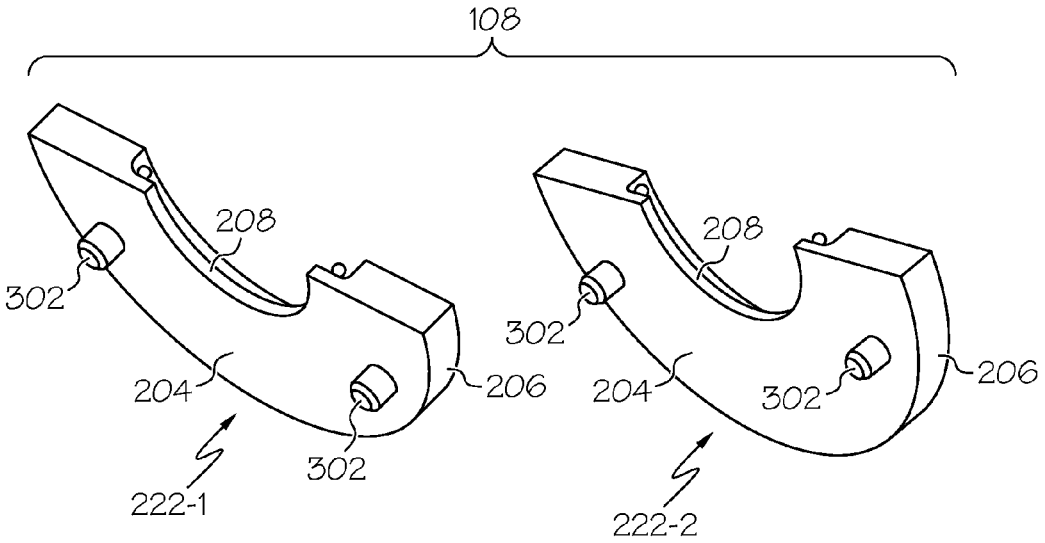
FIGS. 3 and 4 depict different embodiments of a washer that may be used to implement the actuator of FIG. 1.
Figure 4:
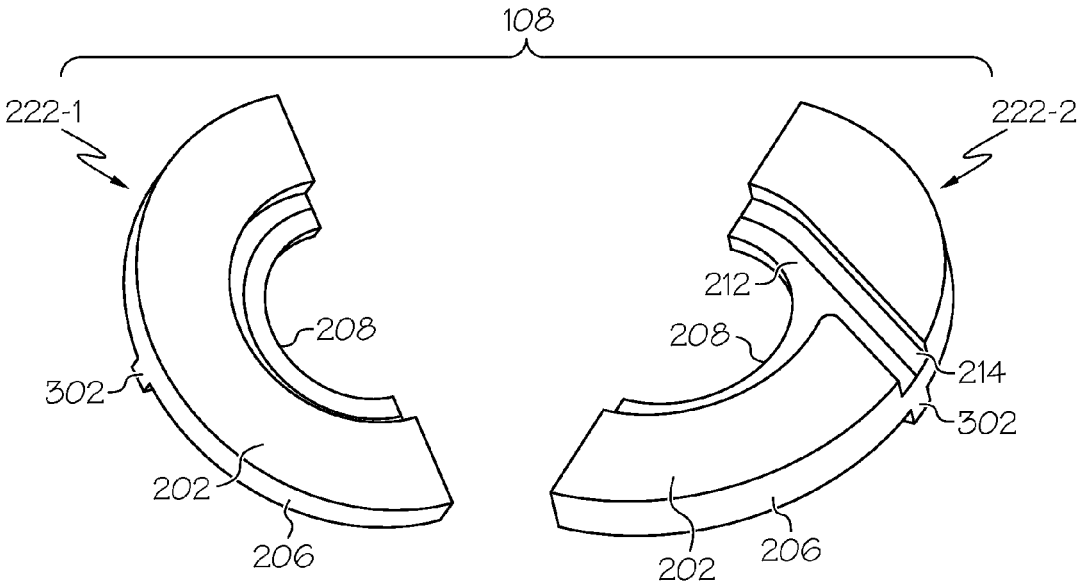

Whether the washer is formed as a single, unitary portion or of multiple portions, the second end surface(s) 204 may be smooth or may have one or more features formed thereon. For example, and as shown more clearly in FIGS. 3 and 4, a plurality of protrusions 302 may be formed on the second end surface(s) 204. The protrusions 302 may be variously configured, but in the embodiment depicted in FIG. 3 the protrusions 302 are configured as rounded studs, and in the embodiment depicted in FIG. 4 the protrusions 302 are configured as rectangular projections.

Figure 5:
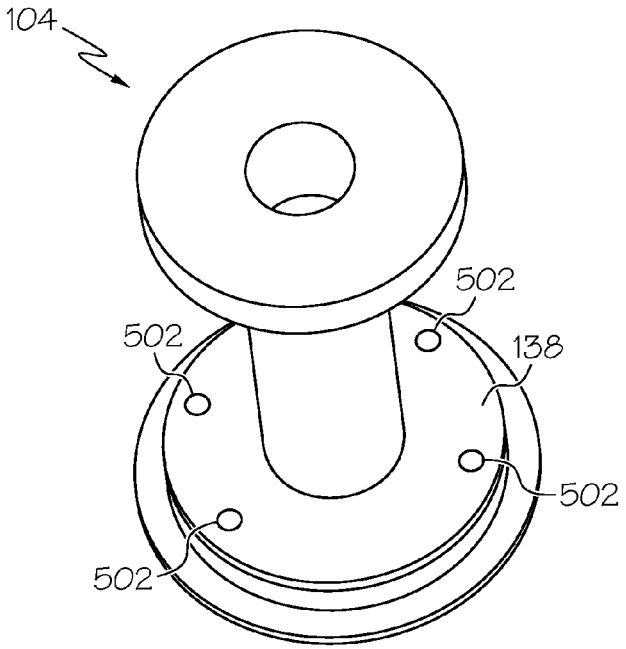
FIGS. 5 and 6 depict different embodiments of a bobbin assembly that may be used to implement the actuator of FIG. 1.
Figure 6:
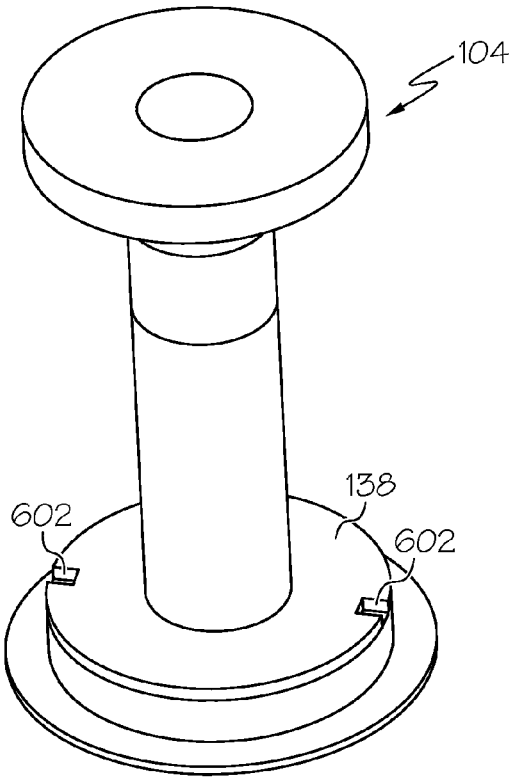

As may be appreciated, when the second end surface(s) 204 has features formed thereon, the return pole 122, and more particularly the flange portion 138, will have mating features formed therein. For example, as depicted in FIG. 5, when the features are the rounded studs 302 depicted in FIG. 3, the return pole 122 has a plurality of pockets 502 formed therein. Each pocket 502 is configured to have one of the rounded studs 302 disposed therein. As FIG. 6 depicts, when the features are the rectangular projections 302 depicted in FIG. 4, the return pole 122 has a plurality of slots 602 formed therein. Each slot 602 is configured to have one of the rectangular projections 302 disposed therein.

Regardless of whether the washer 108 has features formed on the second surface(s) 204, before the washer 108 is installed, the bobbin assembly 104, or at least a portion thereof, is electrically insulated using a suitable dielectric material 168 (see FIG. 1). In one embodiment, the material 168 is a fiberglass insulation tape, and the bobbin assembly 104 is wrapped with two layers of a fiberglass insulation tape. Thereafter, if the second end surface 204 of the washer 108 is smooth, then an adhesive material may be applied to the second end surface 204 to keep the washer 108 in place while the coil 106 is being wound onto the bobbin assembly 104. After the coil 106 is wound, and the bobbin assembly 104 is disposed within the housing 102, the coil 106 and non-illustrated potting will keep the washer 108 in place.

Figure 7:
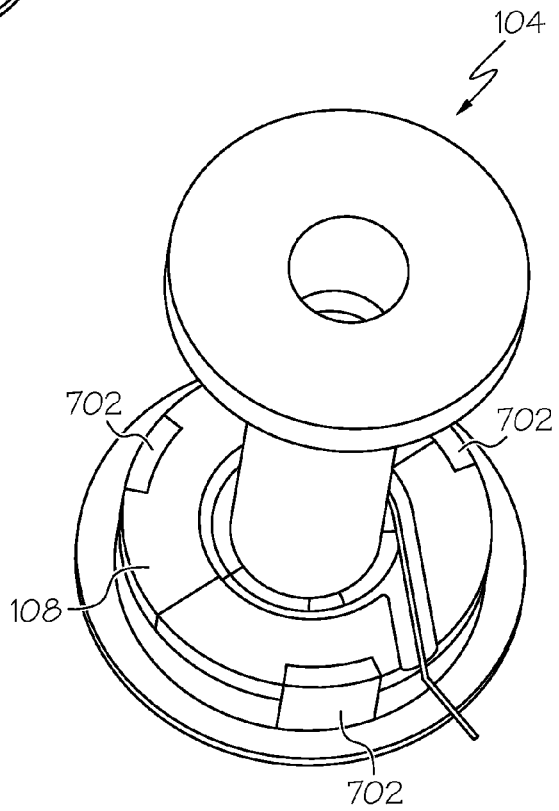
FIG. 7 depicts one embodiment of a bobbin assembly and washer during an initial stage of an assembly process of the actuator assembly depicted in FIG. 1.

If the second end surface 204 has protrusions formed thereon, after the bobbin assembly 104 is wrapped with the insulation tape 168, the washer 108 is put in place by matching the protrusions 302 to the pockets 502 or slots 602, as the case may be, and then, as depicted in FIG. 7, using tape 702 to retain the washer 108 in place. After the coil 106 is wound, the tape 702 may be removed.

Returning now to FIG. 1, it is seen that the depicted housing 102 additionally includes an interconnect section 172. The interconnect section 172 is configured to electrically connect the solenoid actuator 100 to an external system. Thus, the lead wires 146 are routed through the interconnect section 172, via an insulative lead guide 174, for connection to the external system. As FIG. 1 depicts, the configuration and placement of the washer 108 allows the lead wires 146 to be routed directly to the interconnect section 172 without any bends, which provides strain relief for the lead wires 146, and makes the assembly process much less tedious. This also allows a counter bore that is formed in presently known interconnect sections to be eliminated.

The solenoid actuator assembly 100 disclosed herein provides several advantages over presently known solenoid actuator assemblies. In particular, the solenoid actuator assembly 100 described herein is relatively robust and easy to assemble. It exhibits improved electric insulation and short circuit protection. The grooves 212, 214 in the washer 108 provide strain relief for the lead wires 146, and eliminate the need for grooves in the magnetic components (e.g., return pole 122). Thus, the magnetic performance is improved over presently known solenoid actuator assemblies. The number of bends in the lead wires 146 is reduced. And because the counter bore in the interconnect section 172 is eliminated, the mass and overhang of the interconnect section 172 is reduced, which reduces its vibrational impact.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A solenoid actuator, comprising:

a housing;

a bobbin assembly disposed at least partially within the housing, the bobbin assembly including a return pole and an armature, the return pole fixedly coupled to the housing, the armature axially movable within the housing;

a coil disposed within the housing and wound around at least a portion of the bobbin assembly; and a washer disposed between the coil and a portion of the bobbin assembly and surrounding a portion of the return pole, the washer formed of an electrical insulator material, wherein:

the washer includes a first end surface, a second end surface, an outer circumferential surface between the first and second end surfaces, and an inner circumferential surface between the first and second end surfaces;

the first end surface has a circumferential groove formed therein; and a portion of the coil is disposed in the circumferential groove.

2. The actuator of claim 1, wherein the first end surface has an exit groove formed therein that extends between the circumferential groove and the outer circumferential surface.

3. The actuator of claim 1, wherein:

the second end surface has a plurality of protrusions formed thereon; and the return pole has a plurality of pockets formed therein, each pocket having one of the protrusions disposed therein.

4. The actuator of claim 1, wherein:

the second end surface has a plurality of protrusions formed thereon; and the return pole has a plurality of slots formed in an outer surface thereof, each slot having one of the protrusions disposed therein.

5. The actuator of claim 1, wherein the washer comprises a glass ceramic material.

6. The actuator of claim 1 wherein the washer comprises:

a first washer portion surrounding a first portion of the return pole; and a second washer portion surrounding a second portion of the return pole, the second washer portion engaging the first washer portion.

7. The actuator of claim 1, further comprising:

a dielectric material disposed between the coil at least a portion of the bobbin assembly.

8. A solenoid actuator, comprising:

a housing;

a bobbin assembly disposed at least partially within the housing, the bobbin assembly including a return pole and an armature, the return pole fixedly coupled to the housing, the armature axially movable within the housing;

a coil disposed within the housing and wound around at least a portion of the bobbin assembly; and a washer disposed between the coil and a portion of the bobbin assembly and surrounding a portion of the return pole, the washer formed of a glass ceramic material and comprising:

a first end surface, a second end surface, an outer circumferential surface between the first and second end surfaces, and an inner circumferential surface between the first and second end surfaces, and a circumferential groove formed in the first end surface, the circumferential groove having a portion of the coil disposed therein.

9. The actuator of claim 8, wherein the first end surface has an exit groove formed therein that extends between the circumferential groove and the outer circumferential surface.

10. The actuator of claim 8, wherein:

the second end surface has a plurality of protrusions formed thereon; and the return pole has a plurality of pockets formed therein, each pocket having one of the protrusions disposed therein.

11. The actuator of claim 8, wherein:

the second end surface has a plurality of protrusions formed thereon; and the return pole has a plurality of slots formed in an outer surface thereof, each slot having one of the protrusions disposed therein.

12. The actuator of claim 8, wherein the washer comprises:

a first washer portion surrounding a first portion of the return pole; and a second washer portion surrounding a second portion of the return pole, the second washer portion engaging the first washer portion.

13. The actuator of claim 8, further comprising:

a dielectric material disposed between the coil at least a portion of the bobbin assembly.

14. A solenoid actuator, comprising:

a housing;

a bobbin assembly disposed at least partially within the housing, the bobbin assembly including a return pole and an armature, the return pole fixedly coupled to the housing, the armature axially movable within the housing;

a coil disposed within the housing and wound around at least a portion of the bobbin assembly;

a dielectric material disposed between the coil and at least a portion of the bobbin assembly; and a washer disposed between the coil and a portion of the bobbin assembly and surrounding a portion of the return pole, the washer formed of an electrical insulator material and comprising:

a first end surface, a second end surface, an outer circumferential surface between the first and second end surfaces, and an inner circumferential surface between the first and second end surfaces, a circumferential groove formed in the first end surface, the circumferential groove having a portion of the coil disposed therein, a first washer portion surrounding a first portion of the return pole, and a second washer portion surrounding a second portion of the return pole, the second washer portion engaging the first washer portion.

15. The actuator of claim 14, wherein the first end surface has an exit groove formed therein that extends between the circumferential groove and the outer circumferential surface.

16. The actuator of claim 14, wherein:

the second end surface has a plurality of protrusions formed thereon; and the return pole has a plurality of pockets formed therein, each pocket having one of the protrusions disposed therein.

17. The actuator of claim 14, wherein:

the second end surface has a plurality of protrusions formed thereon; and the return pole has a plurality of slots formed in an outer surface thereof, each slot having one of the protrusions disposed therein.

18. The actuator of claim 14, wherein the washer comprises a glass ceramic material.

* * * * *